US008911823B2

(12) United States Patent
Li et al.

(10) Patent No.: US 8,911,823 B2
(45) Date of Patent: Dec. 16, 2014

(54) MECHANICAL SINTERING OF NANOPARTICLE INKS AND POWDERS

(75) Inventors: Yunjun Li, Austin, TX (US); Samuel Kim, Austin, TX (US); Igor Pavlovsky, Cedar Park, TX (US); Zvi Yaniv, Austin, TX (US); Mohshi Yang, Austin, TX (US)

(73) Assignee: PEN Inc., Deerfield Beach, FL (US)

( * ) Notice: Subject to any disclaimer, the term of this patent is extended or adjusted under 35 U.S.C. 154(b) by 207 days.

(21) Appl. No.: 13/099,100

(22) Filed: May 2, 2011

(65) Prior Publication Data

US 2011/0300305 A1 Dec. 8, 2011

Related U.S. Application Data

(60) Provisional application No. 61/330,554, filed on May 3, 2010.

(51) Int. Cl.
*B05D 3/12* (2006.01)
*B05D 5/12* (2006.01)
*C23C 24/08* (2006.01)

(52) U.S. Cl.
CPC ..... *C23C 24/08* (2013.01)
USPC ..... 427/191; 427/98.4; 427/99.2; 427/355

(58) Field of Classification Search
USPC ..... 427/98.4, 99.2, 191, 355
See application file for complete search history.

(56) References Cited

U.S. PATENT DOCUMENTS

| | | | | |
|---|---|---|---|---|
| 4,078,988 | A | 3/1978 | Brandmair et al. | |
| 4,670,351 | A * | 6/1987 | Keane et al. | 428/549 |
| 5,589,652 | A | 12/1996 | Arato et al. | |
| 5,951,918 | A * | 9/1999 | Kuwajima et al. | 174/257 |
| 6,245,099 | B1 | 6/2001 | Edwin et al. | |
| 7,081,214 | B2 * | 7/2006 | Matsuba et al. | 252/512 |
| 7,560,215 | B2 | 7/2009 | Sharma et al. | |
| 7,666,328 | B2 * | 2/2010 | Nair et al. | 252/514 |
| 7,754,106 | B2 * | 7/2010 | Mikhael et al. | 252/500 |
| 2004/0086658 | A1 * | 5/2004 | Onoyama et al. | 427/458 |
| 2005/0255680 | A1 | 11/2005 | Rokhvarger et al. | |
| 2006/0251874 | A1 | 11/2006 | McClure et al. | |
| 2008/0020304 | A1 * | 1/2008 | Schroder et al. | 430/39 |
| 2008/0152789 | A1 * | 6/2008 | Nomoto | 427/98.4 |
| 2008/0286488 | A1 | 11/2008 | Li et al. | |
| 2009/0191356 | A1 | 7/2009 | Lee et al. | |
| 2009/0311440 | A1 | 12/2009 | Li et al. | |
| 2010/0000762 | A1 | 1/2010 | Yang et al. | |

FOREIGN PATENT DOCUMENTS

WO WO 2009/115643 9/2009

OTHER PUBLICATIONS

Zhu et al. "Sintering of Nano-Particle Powders: Simulations and Experiments; Materials and Manufacturing Processes," vol. 11, No. 6, pp. 905-923, 1996.

(Continued)

*Primary Examiner* — Frederick Parker
(74) *Attorney, Agent, or Firm* — Kelly Kordzik; Matheson Keys & Kordzik PLLC

(57) ABSTRACT

Nanoparticle inks and powders are sintered using an applied mechanical energy, such as uniaxial pressure, hydrostatic pressure, and ultrasonic energy, which may also include applying a sheer force to the inks or powders in order to make the resultant film or line conductive.

21 Claims, 22 Drawing Sheets
(15 of 22 Drawing Sheet(s) Filed in Color)

(56) References Cited

OTHER PUBLICATIONS

Kart et al., "Molecular Dynamics Study of the Sintering of Two Equal Sized Cu Nanoparticles," International Workshop on New Trends in Science and Technology, Ankara, Turkey, Nov. 3-4, 2008, 5 pages.
Notification of Transmittal of the International Search Report and the Written Opinion of the International Searching Authority; International Application No. PCT/US11/34995; dated Aug. 17, 2011.
Lindstrom et al., "A New Method for Manufacturing Nanostructured Electrodes on Plastic Substrates," Nano Letters vol. 1, No. 2, 97-100, 2001, published on Internet Jan. 17, 2001.
International Bureau of WIPO, International Preliminary Report on Patentability, International Application No. PCT/US2011/034995, Nov. 6, 2012.

* cited by examiner

MECHANICAL SINTERING OF NANOPARTICLE INKS AND POWDERS

This application claims priority to U.S. Provisional Application Ser. No. 61/330,554, which is hereby incorporated by reference herein.

TECHNICAL FIELD

The present invention is related to conductive lines in printed electronics, and in particular to, forming such conductive lines with a mechanical sintering process.

BACKGROUND

Recently, the printed electronics industry has been rapidly developing utilization of nanoparticle inks that may be printed in many ways, such as screen, flexographic, offset lithography, inkjet, aerosol jet printing, etc. Furthermore, the printed electronics business has a bright future in the field of flexible devices that are using flexible substrates. In this case, the inking, the printing, and/or the powder deposition are performed on flexible substrates, which generally cannot withstand high temperatures required for the sintering of the nanoparticle inks and powders to transform their properties to their original bulk material properties. One of the techniques described in the published literature is photosintering that uses a strong flash of light energy, which is absorbed by the particles in order to sinter. For example, see U.S. Published Patent Application Serial Nos. US 2008-0286488 A1, US 2009-0311440 A1, and US 2010-0000762 A1, which are hereby incorporated by reference herein. In many instances, this flash of electromagnetic energy does not fit the application and production requirements, such as the final adhesion, the final thickness of the traces, the rate of production, the adaptability to roll-to-roll process, etc., and as a result, the required composition of the inks becomes very complicated and customized.

SUMMARY

Embodiments of the present invention utilize simpler methods of transferring the energy to nanoparticle inks and powders to achieve sintering, which are compatible with low temperature processes (including room temperature) required to produce electronics on certain substrates. Embodiments of the present invention utilize novel nanoparticle inks and powders that by suitable methods may sinter in response to an applied mechanical energy, for example uniaxial pressure, hydrostatic pressure, ultrasound, etc.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1A:
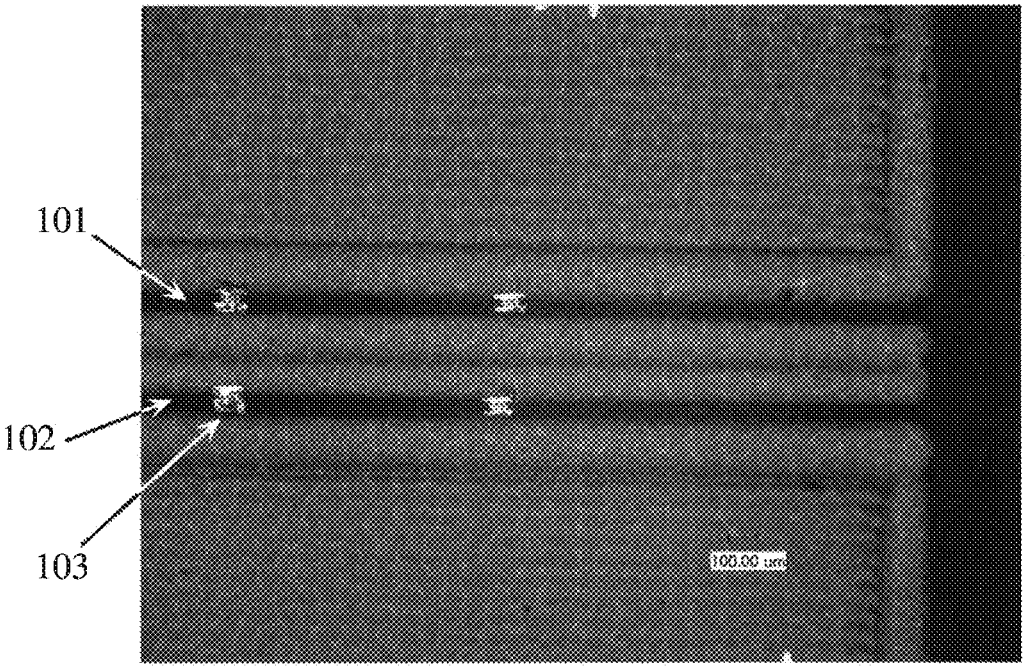
FIG. 1A shows a digital image of ultrasonically sintered pads produced from unsintered copper nanoparticles.

In this application, insulating materials are processed so that they are made to be conductive. A conductive material relative to an insulating material is one in which the outer electrons are more free to leave the parent atoms than the electrons of insulating materials. Another manner for defining these terms is to consider that an insulator, or a material with a high resistivity, has a very high resistance to electric current so that the current flow through it is usually negligible. Relative to electronic devices, to which embodiments of the present invention are useful, making a material conductive from insulating results in the conductive material now satisfactory for enabling sufficient electric current to be transmitted in the conductive material so that connected electronic devices properly function. More specifically, the sheet resistance of an insulating film is greater than $10^6$ ohm/square. The sheet resistance of a conductive film is less than $10^6$ ohm/square.

The sintering and consolidation of nanoparticle powders has been previously investigated (see "Sintering of Nano-Particle Powders: Simulations and Experiments, H. Zhu et al., Materials and Manufacturing Processes, Vol. 11, No. 6, pp. 905-923, 1996, which is hereby incorporated by reference herein). Generally, when small particles contact each other, high shear stresses are developing at the points of contact. In fact, this property is a "nano-effect," and indeed, large particles are behaving differently from nanoparticles with respect to the development of these high shear stresses. The surprising result is that an atomistic approach using molecular dynamics (MD) simulation show that metal nanoparticles can actually sinter at very low temperatures on a scale of tens of picoseconds.

In the case of powders, the initial packing configuration has significant influence on the sintering mechanism. When two nanoparticles approach each other and the distance between them is less than 0.5 nanometers (the cut-off of the interatomic potential), the two particles immediately attract each other and form "necks," and the system of the two particle undergoes shrinkage. The shrinkage is due to two distinct effects: at the beginning of the particle attraction, the shrinkage is very rapid, which is due to elastic deformation; additional shrinkage can occur only if atoms are transported from the "neck area" to pore surfaces (spaces between the nanoparticles) and this requires grain boundary diffusion, bulk diffusion, or what is referred to as elastic deformation.

The sintering of two particles by contact is amplified if the points of contact between the particles form low energy boundaries. The pressure due to the stress at the points of contacts is very important for determining self-sintering or induced sintering. For example, sintering can be achieved without applying the pressure, if the nanoparticles are assembled in a closed packed organization.

The sintering mechanism, when two nanoparticles are put in contact, will depend on (a) initial packing, (2) applied stress, and (3) particle size. In fact, it was discovered that the local stress in the neck region between two spherical particles may approach the theoretical strength of metal when the particle radii fall below 30 nanometers. It was further discovered that the relation between the average pressure P over the neck and the maximum shearing stress σ are related by the following formula:

$$P = 0.41\left(\frac{FE^2}{R^2}\right)^{1/3}$$

and $$\sigma = 0.46P$$

where E is the Young modulus of the nanoparticle, R is the radius of the nanoparticle, and F is the force operating normal to the area of contact between the two spherical particles.

An interesting effect is that the grains at the boundary may at first rotate to form larger grains. With the passage of time, the grain boundary area becomes highly distorted and this creates large internal stresses. The only way to relieve these stresses is densification. The large stresses in the boundaries also result in the lowering of melting temperature and the melting of grain boundary (or amorphisation). This leads to rapid sintering, facilitates grain rotation, and enhances grain boundary migration.

One can calculate, for example, that the maximum shearing stress when two copper particles are brought together can be as high as 7.4 GPa for 2.5 nanometer particles. As a result, the external pressure to apply should also be of a similar magnitude. When external pressure is applied, the densification rate increases, and it is faster in the case of uniaxial pressure as compared to hydrostatic pressure. One difference between hydrostatic pressure and uniaxial pressure is the fact that no evidence for grain boundary sliding is observed under hydrostatic pressure. Inducing sliding of the grain boundaries is important in the processes described.

This important grain boundary sliding in the sintering process generally requires atomic motion at the boundaries, meaning plastic deformation. An important parameter when pressure is applied is that this pressure produces a strong shear stress component at the boundary. The Molecular Dynamics simulation shows that two important effects should take place during exercising external pressure for improving the sintering: (1) shear stresses cause grain boundary sliding and sliding enhances densification; and (2) sliding is dependent on grain boundary diffusion. The grain boundary sliding contributes to the removal of the pores that are formed during the initial imperfect packing of particles. The rapid sintering of nanoparticles in contact is due to the high shear stresses developed in small particle contact, which exceeds the theoretical mechanical strength of the particles. Application of external pressure accelerates the process of densification, but the uniaxial pressure is more efficient due to grain boundary sliding.

Thus, external uniaxial pressure is advantageous in the sintering of nanoparticles; if this uniaxial pressure contributes to a strong component of high shear stress at the contact between the particles, there is considerable benefit to the sintering process.

An experiment by the inventors proved that copper inks can be ultrasonically sintered. In the experiment, the probes of an ultrasound wire bonding machine were utilized, achieving as a result of pressure and ultrasound, sintering of copper nanoparticles at room temperature.

Figure 17A:
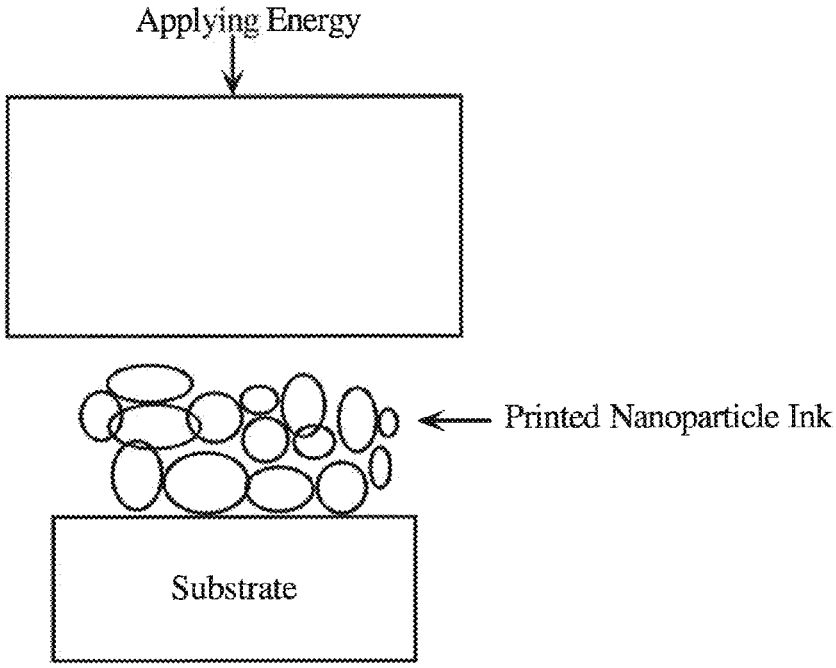
FIGS. 17A-17C illustrate embodiments of processes of mechanically sintering printed nanoparticle inks in accordance with embodiments of the present invention.
Figure 17B:
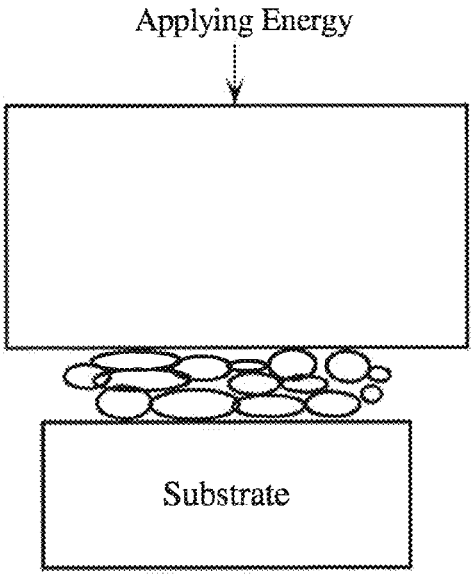
Figure 17C:
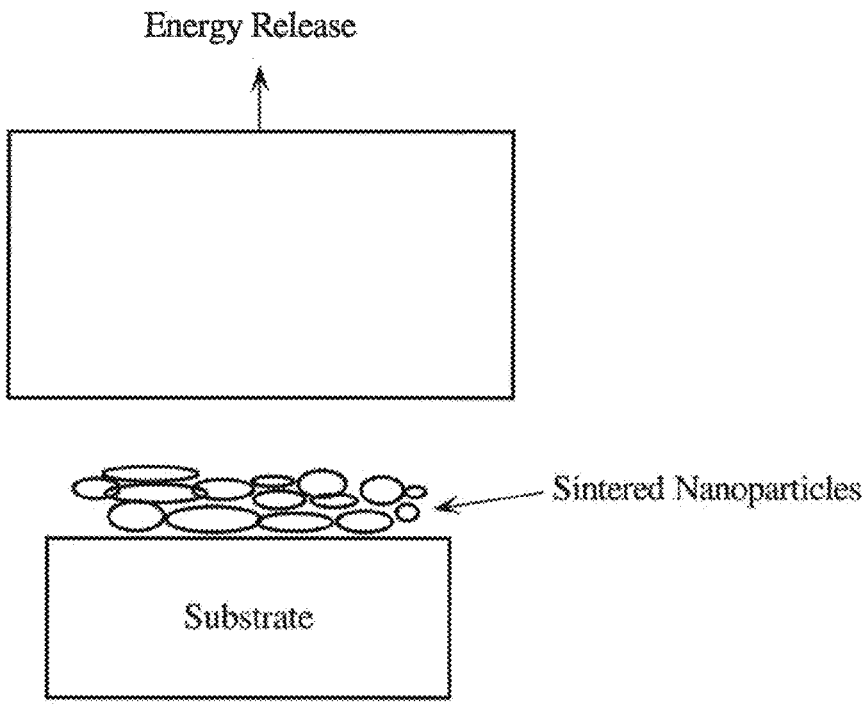
Figure 20:
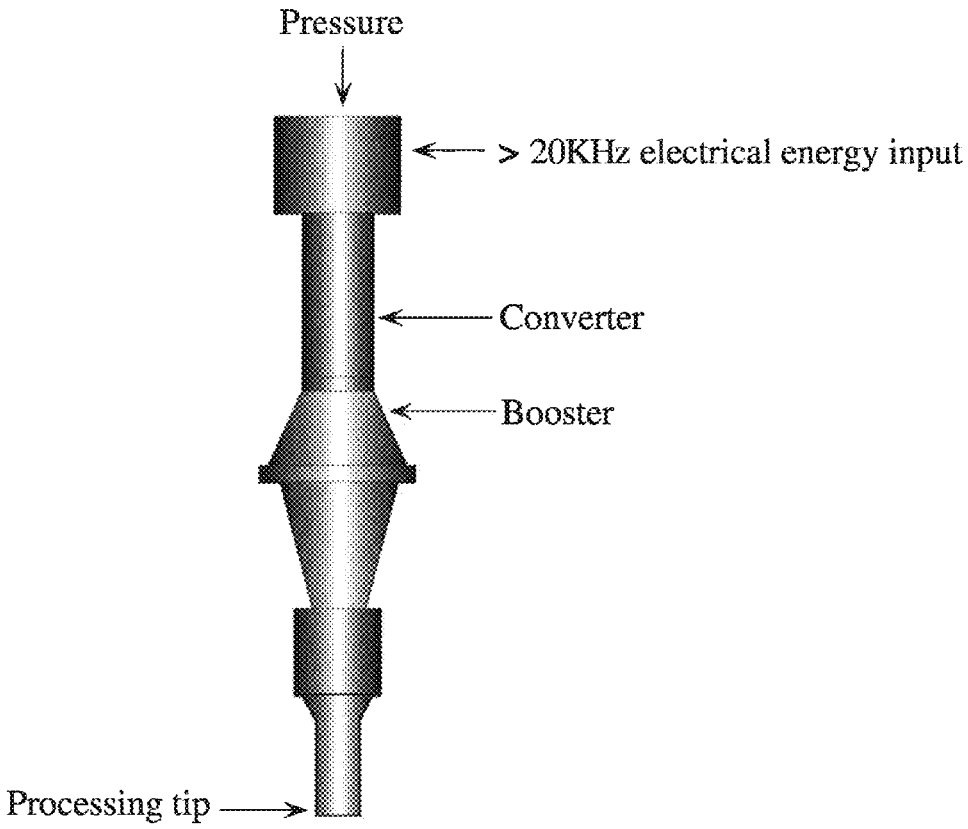
FIG. 20 illustrates a schematic diagram of a welding tip for ultrasonically sintering nanoparticles in accordance with embodiments of the present invention.

Ultrasonic techniques are used for wire-bonding, metal welding, and thermoplastics welding. Ultrasonic welding causes local heating or melting of materials due to absorption of vibration energy. Referring to FIGS. 17A-17C and 20, in embodiments of the present invention, such ultrasonic power is converted into heat for sintering nanoparticles. With a pressure applied on the nanoparticles, using such an ultrasound wire bonding probe is utilized to sinter and press down on the nanoparticles at the same time to reduce the pores in the copper films. FIG. 20 illustrates a schematic diagram of such a welding tip for ultrasonic sintering of nanoparticle powders or inks. An electrical energy input into the welding tip is passed through the converter, which changes the electrical energy into mechanical vibratory energy at an ultrasonic frequency. The vibratory energy may be transmitted through a booster stage to increase the amplitude of the vibratory energy. The vibratory energy is then transmitted to the tip for processing the nanoparticle ink or powder to mechanically sinter it. Additionally, a force may be applied on the welding tip to further press it into the nanoparticle ink or powder, applying a pressing force in addition to the application of the vibratory energy. Referring to FIG. 17A, the vibratory energy is applied to the printed nanoparticle ink or powder deposited as a film or layer on a substrate, with FIG. 17B showing the application of the energy, and FIG. 17C showing a removal or release of the applied energy from the sintered nanoparticles. The applied energy can take the form of such examples as uniaxial pressure, hydrostatic pressure, acoustic energy (high frequency ultrasonic vibrations), etc., as further described in this disclosure.

An example of the device in FIG. 20 is an ultrasonic wedge wire-bonding machine, commercially available as the 4500 Digital Series manufactured by Kulicke & Soffa Industries, Inc., which may be used for sintering copper inks or copper nanoparticles as previously described. Because the bonding head is small and not flat, the sintering area may be as small as less than 100 microns and may not be uniform. The bonding head may be applied with a force ranging from a few grams to 30 grams, corresponding to a pressure from a few MPa to 30 MPa.

Figure 1B:
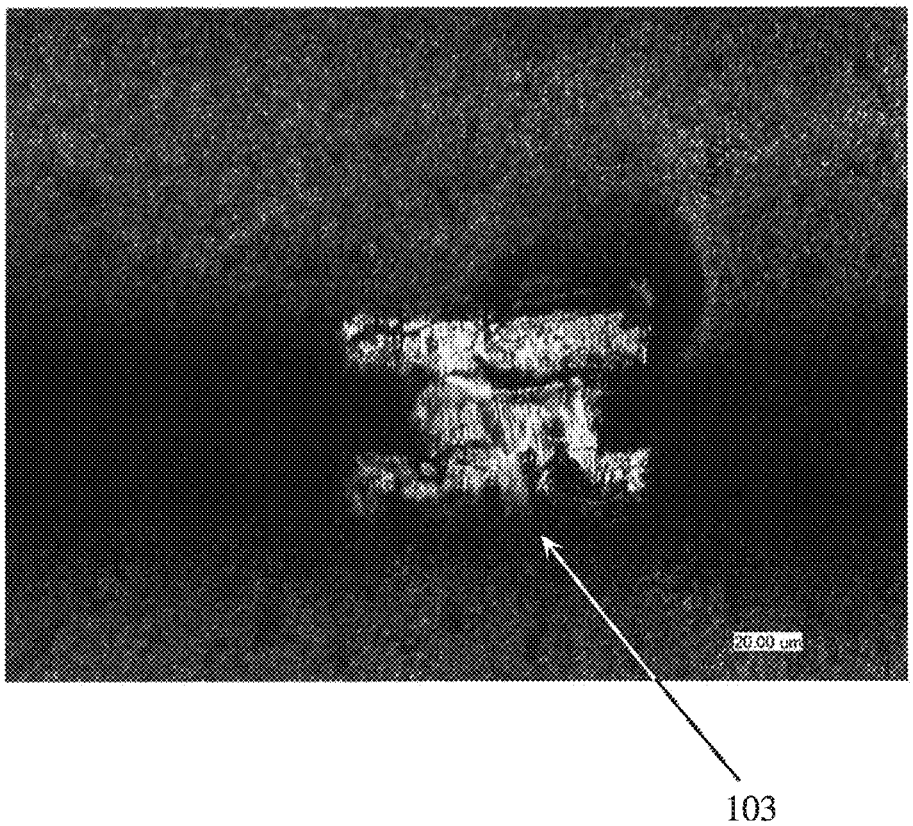
FIG. 1B shows an enlarged image of one of the ultrasonically sintered pads of FIG. 1A.

Referring to FIG. 1A, copper conductive patterns (regions A, B, C) were produced by laser sintering on a Kapton substrate (e.g., a Kapton E polyimide substrate) with approximately 40 μm gaps 101, 102. An ultrasonic bonding head (for example, as shown in FIG. 20) was applied in between the conductive patterns to sinter copper nanoparticles in the 40 μm wide gaps at specific spots 103. FIGS. 1A-1B show that the color of the ultrasonic sintered areas (4 pads 103) changed from black to gold-like in color. FIG. 1B illustrates an enlarged digital image of one of the ultrasonically sintered pads 103 shown in FIG. 1A. Due to heat spreading of laser sintering, the resistance between regions A and C before the ultrasonic sintering was measurable, ranging from 260Ω to 4.2 KΩ for four different samples all produced in a similar manner as the sample shown in FIG. 1A. After ultrasonic sintering, the measured resistances between regions A and C significantly decreased, as indicated in Table 1.

TABLE 1

| Samples | 1 | 2 | 3 | 4 |
|---|---|---|---|---|
| Resistance (before ultrasonic sintering) | 260 Ω | 520 Ω | 4.2 KΩ | 9.8 KΩ |
| Resistance (after ultrasonic sintering) | 6.7 Ω | 49 Ω | 30 Ω | 50 Ω |

Figure 2:
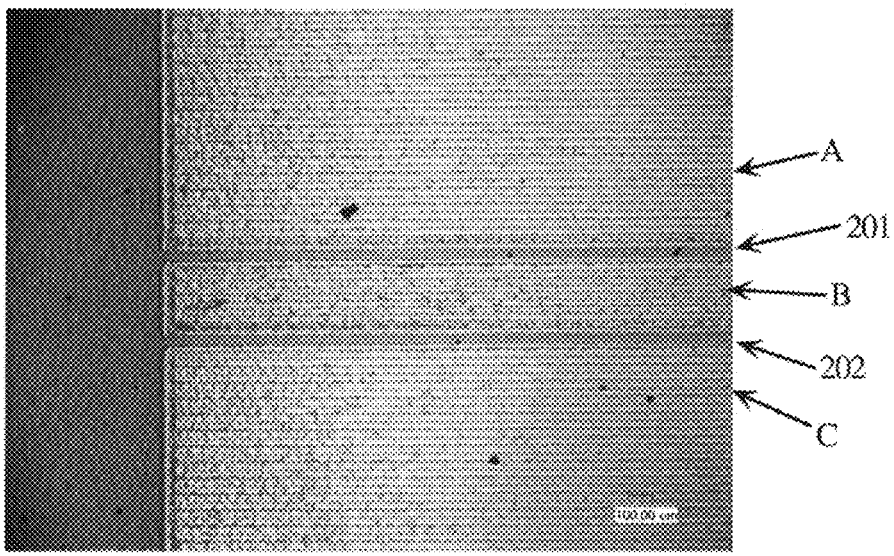
FIG. 2 shows a digital image of a conductive copper pattern with 40 micron gaps produced by laser sintering.

FIG. 2 shows a sample with copper conductive patterns produced by laser sintering on a Kapton substrate with about 40 μm gaps 201, 202 where the copper ink in the gaps was removed. The measured resistances between the three zones A, B, and C were electrically open (insulating). A copper ink was drop-printed on the sample to cover the gaps 201, 202. Then the sample was baked at about 100° C. for about 30 minutes.

After baking, an ultrasonic bonding head, such as shown in FIG. 20, was applied to the copper ink in the 40 μm wide gaps 201, 202 for sintering. After sintering, the measured resistance between the zones A, B, and C decreased to about 4Ω.

Figure 3:
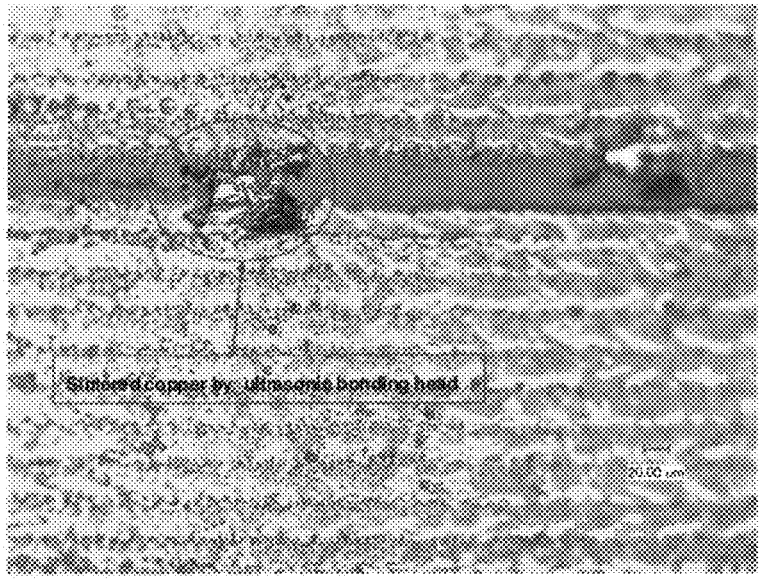
FIG. 3 shows a digital image of a sintered copper bridge across one of the gaps of FIG. 2.

Then, the sample was cleaned by water to remove the unsintered copper ink. FIG. 3 shows the sintered copper ink bridge across the 40 μm wide gap where the ultrasonic bonding head was applied. A similar copper color as laser-sintered copper was observed indicating sintering of copper nanoparticles was accomplished.

The above experiments showed that an ultrasonic bonding head tip such as shown in FIG. 20 can to sinter a layer of copper inks or copper nanoparticles. This technique can be used to repair conductive traces in electrical circuits. Copper inks filled in via holes in PCBs (printed circuit boards) can also be sintered by ultrasonic sintering to form through-hole copper conductors.

By contrast, when a wire-bonding machine with zero ultrasonication energy was applied to samples as previously described and shown, there was no measurable resistance change with such a mere application of a static force. However, a resistance drop was then obtained after applying ultrasonication energy on the same sample. This is further evidence that merely applying a static force on a layer of copper ink does not effectively sinter the ink.

In another experiment, a copper ink layer, or film, deposited on a polyimide substrate was mechanically pressed between two metal plates under 3000 psi, 4000 psi, and 6000 psi, with the result being that the copper ink was still insulating. (The pressure in the utilized equipment was calculated from the weight applied on the sample divided by the area of the sample; the weight in the three cases above was 3 tons, 4 tons, and 6 tons, and the area of the sample was 6.15 $cm^2$.) Thus, again this is evidence that merely applying a static force is not effective in sintering copper nanoparticles. This ink, however, can be sintered by pressing with a three-roll machine or a spatula to make the copper ink conductive, such as on a polyimide substrate. Both a roller and a spatula apply a shear force during such pressing.

Figure 18:
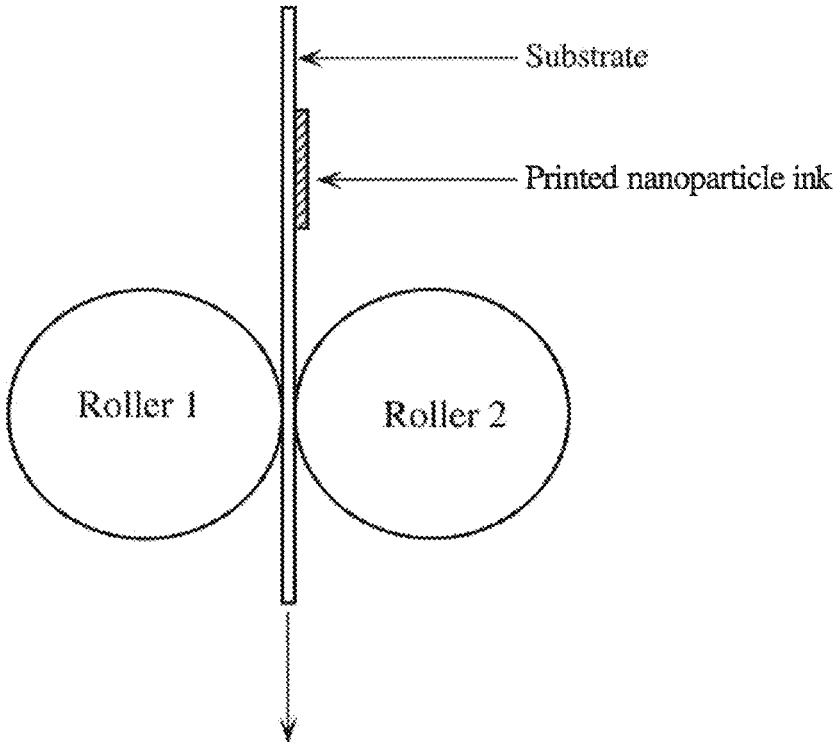
FIG. 18 illustrates a schematic of a 2-roll or 3-roll machine used to press nanoparticle inks printed on a substrate in accordance with embodiments of the present invention.

FIG. 18 illustrates how a 2-roll or 3-roll machine, as is known in the art, may be used to press nanoparticle ink or powders printed on a substrate between the rollers. The pressure between the rollers can mainly depend on both the gap between the rollers and the thickness of the substrate. One or more of the rollers may be heated to a relatively high temperature during the process, for example up to 150° C., or even 250° C., as examples, to further enhance the sintering process.

Figure 19:
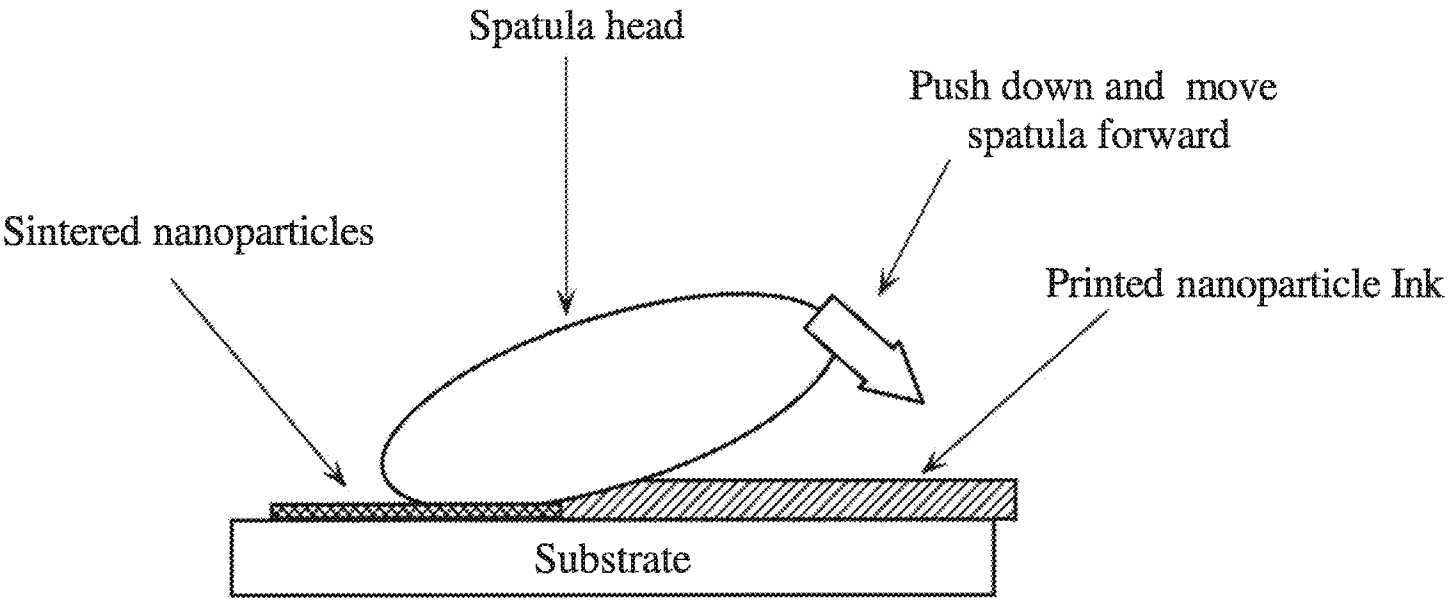
FIG. 19 illustrates mechanical sintering of a printed nanoparticle ink film with a spatula.

FIG. 19 illustrates a simplified schematic of a use of a head of a spatula to press down on the nanoparticle ink or powders deposited on a substrate, such as through a printing process. As the spatula head is pushed down onto the nanoparticles, it may be moved forward along the nanoparticle film as nanoparticles are pressed underneath the spatula so that they become mechanically sintered.

Figure 4:
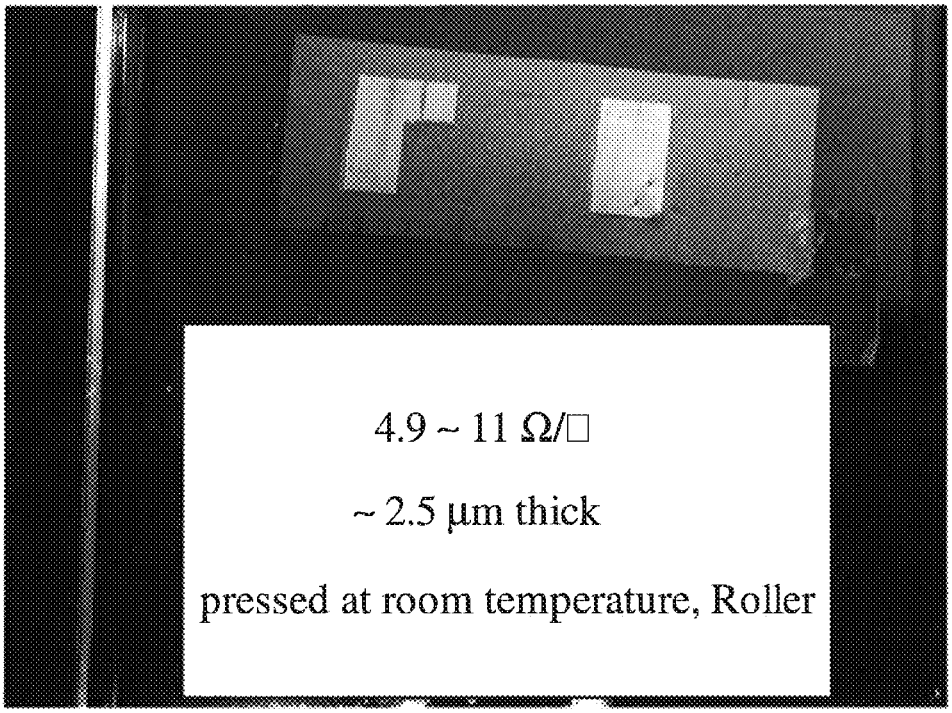
FIG. 4 shows a digital photograph of results of an experiment where patterned copper ink on a PET substrate was sintered by pressing at room temperature.

Referring to FIG. 4, another experiment was then performed to determine if specific directional pressure can create sintering. The inventors demonstrated again with this experiment that even with applying uniaxial pressure of approximately $10^8$ Pa, the copper ink was still insulating. On the other hand, by using a two-roller or three-roll machine or spatula, that in addition to regular pressure, when a strong shear force is applied on the copper ink or powder, excellent conductive traces are obtained.

Therefore, such experimental results clearly show that when using pressure, such as with utilizing a roller pressing process, good sintering is achieved with low resistivity traces at room temperature, and thus such a process is compatible with a roll-to-roll printing process and results in strongly adhered traces of copper on PET. Roll-to-roll printing techniques, such as flexo printing and gravure printing, can be used to print nanoparticle inks or powders on a flexible substrate. After drying the printed inks, a roller pressing process, such as shown in FIG. 18, can be used to sinter the printed nanoparticle ink. Instead of pressing copper ink or copper nanoparticles at room temperature, alternatively the roller may be heated as described above with respect to FIG. 18 to obtain lower resistance and better conductivity on a PET substrate.

In another experiment, digital printing was utilized in conjunction with a pressure application. Digital printing of inks, such as ink jet printing, may be suited to form patterns of the nanoparticle inks on substrates, for example patterns deposited at room temperature and dried at a temperature less than or equal to 100° C. After drying, a number of methods may be utilized to apply pressure on the ink patterns, such as roller or a rollers pressing process at room temperature or higher temperatures compatible with specific substrates to ease on the sintering process and achieve conductive copper traces. It is possible that these inks will not possess the same characteristics as the inks utilized for a photosintering process, but they will be formulated with a higher concentration of volatile components.

Instead of inks, a process may be implemented utilizing methods of powder deposition in a way very similar to the one utilized in the powders used by the technologies of copiers. Embodiments of the present invention are applicable to both inks and powders. In fact, copier technology transitioned from powder to liquid toner, so both methods can be taken into account. One implementation is to utilize high velocity powder applicators (for example, aerosol jets) in such a way as to digitally deposit the powder. Another implementation is to use powdery toner as stated above or even liquid toner (see U.S. Pat. No. 7,560,215, which is hereby incorporated by reference herein). Any other methods of imprinting electrophotographically conductive inks traces followed by regular image transfer techniques as utilized in the copiers industry may be utilized. The next stage is a pressure application in order to achieve the necessary sintering of the traces. In order not to apply the pressure directly on the traces, a self-release layer may be used to separate the material that presses on the traces from the traces themselves. This release layer may then be discarded.

In an effort to study the mechanical pressing effect on copper nanoparticles, several samples were made by ink jetting lines on polyimide substrates with copper ink made with commercially available copper nanoparticles. The samples were put through a 2-roll mill, such as in FIG. 18, for pressing. Electrical properties and film porosities were measured.

Experimental parameters were:

Ink material: I-70 formulated with copper nanoparticles

Substrate: Kapton E

Ink-jet printing lines: Dimatix ink-jet printer (commercially available)

Drying: at 100° C. in air for 30 minutes

Sample 1—tested as deposited

Sample 2—pressed only by 2-roll mill

Sample 3—pressed by 2-roll mill and then photosintered

Sample 4—only photosintered

Figure 5A:
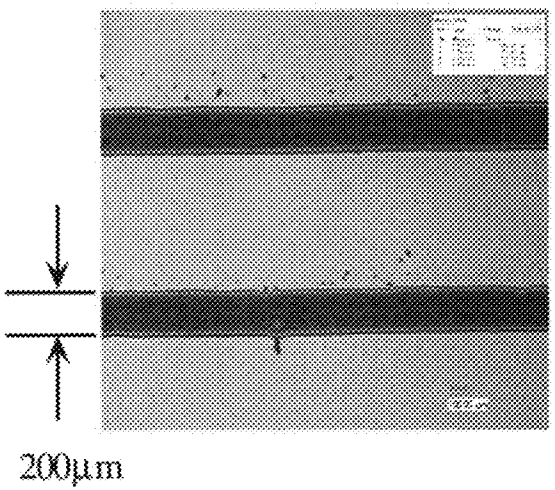
FIG. 5A shows a digital image of an ink jetted line with a width of 200 microns (μm)
Figure 5B:
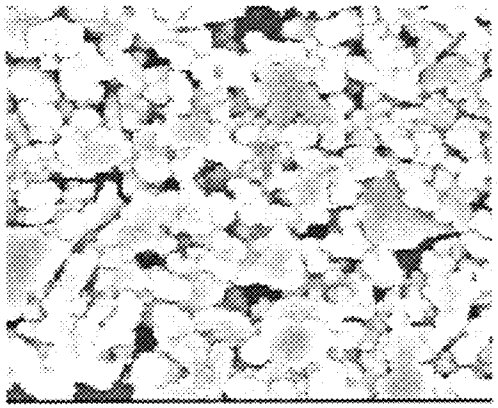
FIG. 5B illustrates a digital image of an SEM top view of one of the ink jetted lines of FIG. 5A.
Figure 5C:
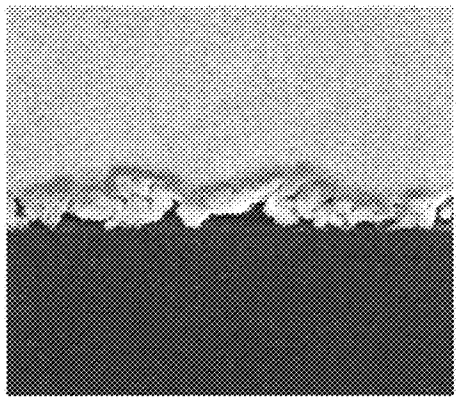
FIG. 5C shows a digital image produced by a focused ion beam (FIB) of a cross-section of one of the ink jetted lines of FIG. 5A.

FIGS. 5A-5C show results for Sample 1, which was tested as deposited. As shown in FIG. 5A, the I-70 ink made of copper nanoparticles was ink jet deposited on Sample 1 forming 200 μm wide lines. Referring to FIG. 5B, an SEM image of a top view of a line showed that some nanoparticles at the drying stage were already agglomerated and aggregated into 100-300 nm sizes. Referring to FIG. 5C, a focus ion beam (FIB) image of a cross-section of a line showed there was de-wetting of the line at the polyimide surface. This indicated that a standard prototype ink formulation may not be compatible with the utilized copper nanoparticles, as it deposited in a manner that formed quite a few pores. The average porosity of the film analyzed by imageJ software (commercially available software that allows the user to obtain the ratio of pore area and solid sintered copper area in a two dimension image) was about 9.75% and was consistent with a typical unsintered film.

Figure 6C:
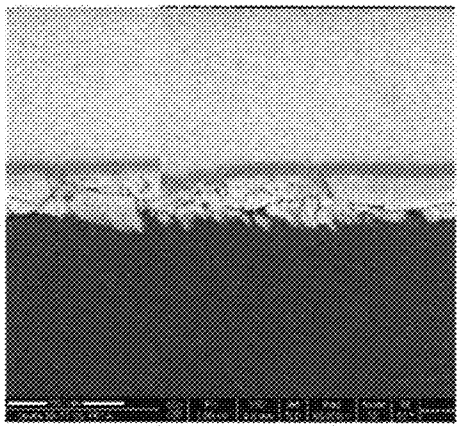
FIG. 6C shows an FIB cross-section image of the sample of FIG. 6A, showing that most of the top of the copper films sintered by pressing has large flakes.
Figure 6B:
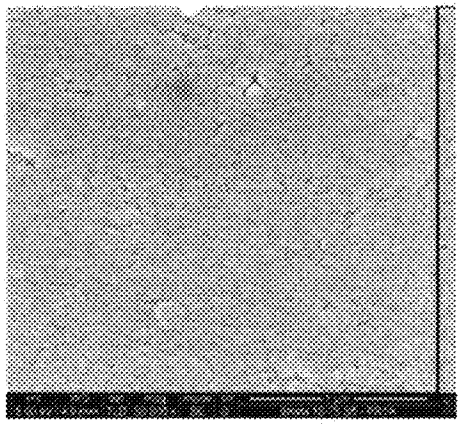
FIG. 6B shows a high magnification SEM image of a top view of FIG. 6A showing a smooth surface after pressing.
Figure 6A:
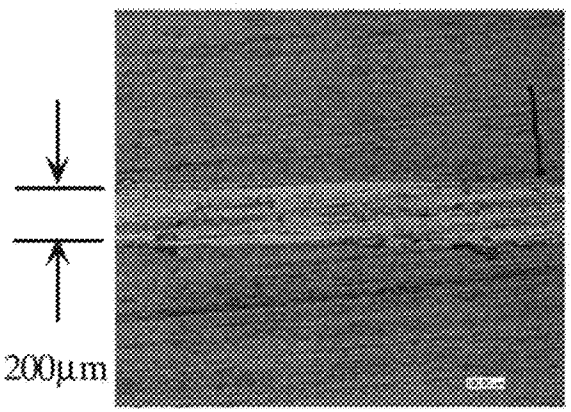
FIG. 6A illustrates a sample pressed with a 2-roll mill, showing some areas on the line having been scratched.

FIGS. 6A-6C show results for Sample 2, which was only pressed with a 2-roll mill. As shown in FIG. 6A, the I-70 ink made of copper nanoparticles was ink jet deposited on Sample 2 forming at least one 200 μm wide lines. After pressing with a 2-roll mill, such as shown in FIG. 18, Sample 2 exhibited a light brown shiny surface, indicating that small particles on the surface area became larger and reflected more light from surroundings. As shown in FIG. 6B, on some degree, SEM images did show nanoparticles aggregated at top of layer. The pores in the deposited film as described in Sample 1 were flattened and already filled in Sample 2. However, even with partial sintering by mechanical pressure, the line resistance of the film was still very high, as an open circuit. The average porosity analyzed by imageJ software was improved, down to 2.9%, as indicated in FIG. 6C. The mechanical scratch damage on the line surface area occupied about 1-2% of the total printed area.

Figure 7C:
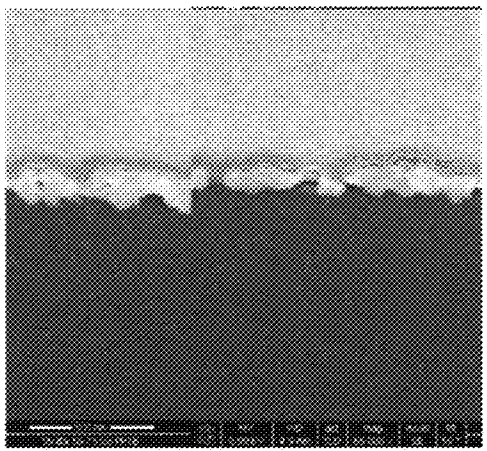
FIG. 7C shows a FIB cross-section image of the sample of FIG. 7A.
Figure 7B:
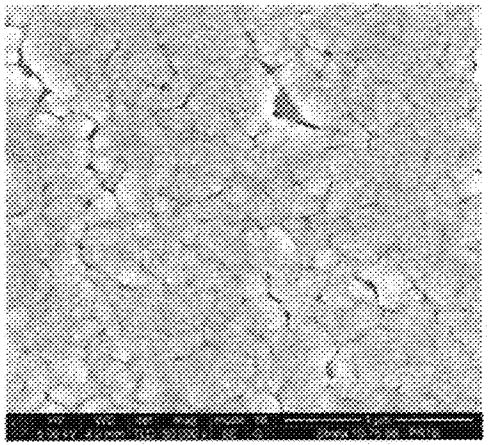
FIG. 7B shows a high magnification SEM image of a top view of the sample of FIG. 7A.
Figure 7A:
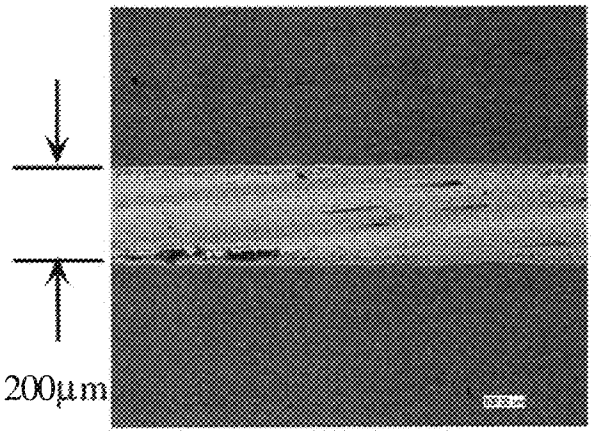
FIG. 7A shows a sample pressed and photosintered.

FIGS. 7A-7C show results for Sample 3, which was pressed with 2-roll mill and then photosintered. The I-70 ink deposited as a 200 μm line in Sample 3 was pressed with a 2-roll mill first and then photosintered. The line had an electrical open circuit at pressing and became conductive after photosintering, with a resistivity of about $3.85\times10^{-5}$ ohm-cm. The cross-section FIB image of FIG. 7C showed there were a few pores at an interface between the copper film and the polyimide substrate. The average porosity after photosintering increased to 5.85% when compared with 2.9% porosity of the Sample 2 that was merely mechanically pressed.

Figure 8C:
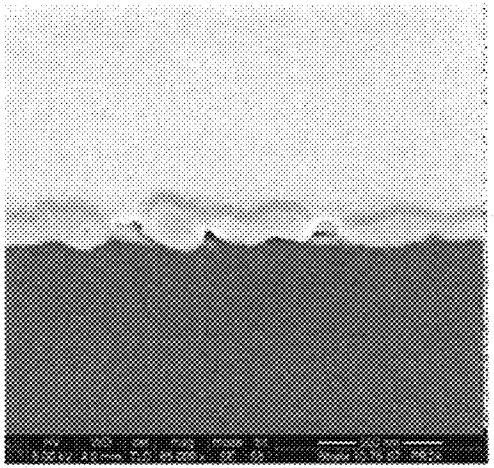
FIG. 8C shows an FIB cross-section image of the photosintered line of FIG. 8A.
Figure 8B:
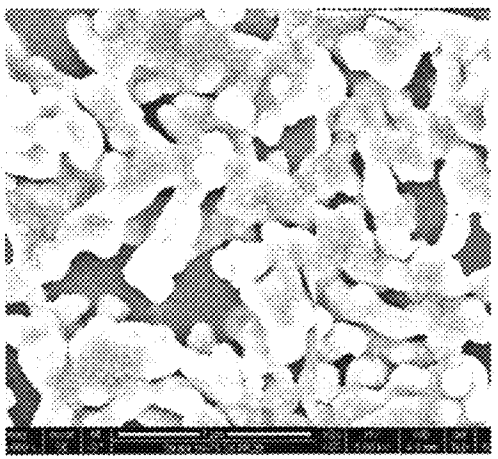
FIG. 8B shows a high magnification SEM image of a top view of the photosintered line of FIG. 8A.
Figure 8A:
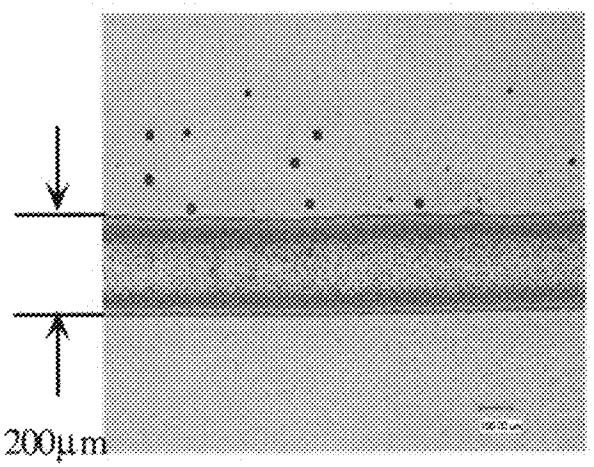
FIG. 8A shows a digital image of a sample, which is an ink jetted copper line after it has been photosintered.

FIGS. 8A-8C show results for Sample 4, which was only photosintered. In Sample 4, the I-70 ink was printed with a standard ink jet process, and merely photosintered for comparison with Samples 1-3. The copper film thickness was 0.5 μm and 0.2 μm before and after photosintering, respectively. The resistivity decreased as expected to about $1.54\times10^{-5}$ ohm-cm. As shown in FIGS. 8B-8C, the porosity increased from 9.75% to 13.4%.

TABLE 2

| Sample | Treatment | Thickness (μm) Prior to Treatment | Thickness (μm) after Treatment | Resistivity (ohm-cm) | Average Porosity |
|---|---|---|---|---|---|
| 1 | none | 0.5 | NA | $1.00 \times 10^{3}$ | 9.75% |
| 2 | pressed only | 0.5 | 0.5 | $1.00 \times 10^{3}$ | 2.90% |
| 3 | pressed plus photosintering | 0.5 | 0.35 | $3.85 \times 10^{-5}$ | 5.85% |
| 4 | photosintering only | 0.5 | 0.2 | $1.54 \times 10^{-5}$ | 13.40% |

Referring to Table 2, the following summary is provided:

Regarding the experiment for Sample 1, copper ink made of copper nanoparticles was ink-jettable and capable of forming 200 μm lines. There was de-wetting between the deposited ink and the polyimide substrate, which created many pores in the deposited lines. The average porosity was 9.75%, and the film was not conductive prior to any treatment.

Regarding the experiment for Sample 2, the ink jetted copper film surface became smoother after a 2-roll mill mechanical pressing. At its surface, nanoparticles formed thin flakes, which is evidence that some nanoparticles began to fuse and sinter. The color of the film changed from dark brown to light brown. Some mechanical damage on the surface was observed. The porosity of Sample 2 relative to Sample 1 improved from 9.75% to 2.90%. However, the line was still not conductive (very high resistivity).

Regarding the experiment for Sample 3, the ink jetted copper film with further photosintering after being mechanically pressed became conductive with $3.85\times10^{-5}$ ohm-cm resistivity. The thickness reduced from 0.5 μm to 0.35 μm. The porosity increased to 5.85%.

Regarding the experiment for Sample 4, the ink jetted copper film was merely photosintered and exhibited a light brown color with $1.54\times10^{-5}$ ohm-cm resistivity. The thickness was reduced from 0.5 μm to 0.2 μm. The porosity increased to 13.4%.

A problem with metallic inks is their porosity. This porosity should be decreased as much as possible, in the ink deposited and dried and also after sintering. The following description shows that with only pressing the inks, the porosity drops by at least a factor of 3, while the photosintering increases the porosity. The conductive quality of the traces are a combination of sintering quality and final porosity, and the results indicate that improvements in sintering of metallic inks are achieved when photosintering is eliminated or reduced, and the material is sintered by applying mechanical pressure means without photosintering.

Figure 16:
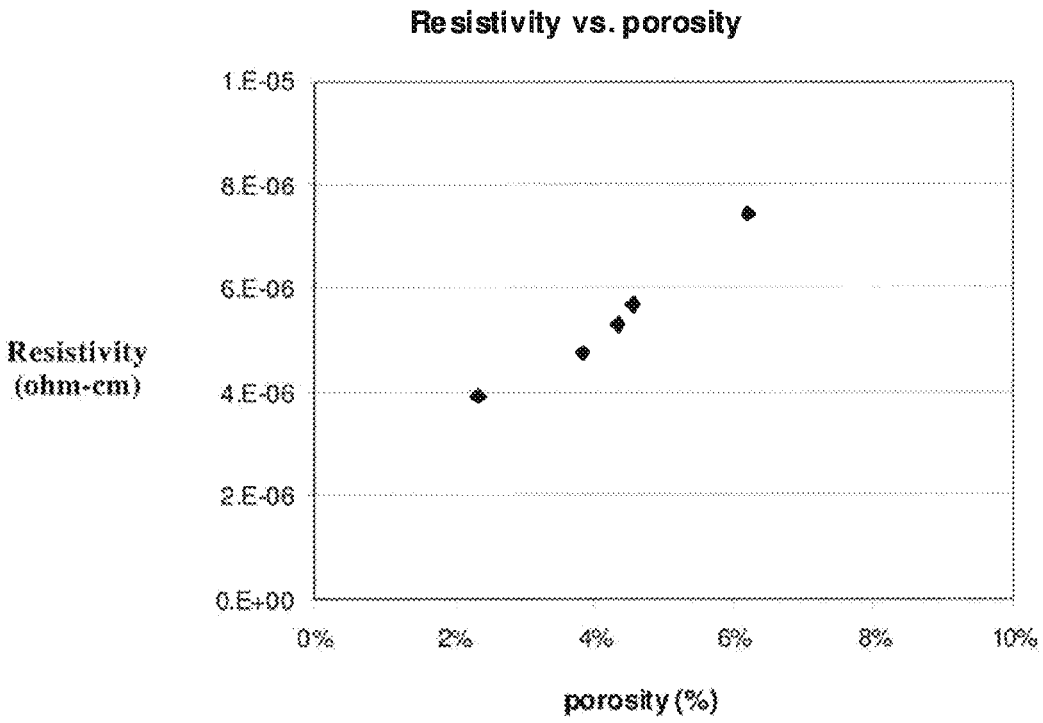
FIG. 16 illustrates a graph of resistivity versus porosity, which indicates that resistivity is proportional to porosity in samples produced in accordance with embodiments of the present invention.

With development on new MMB (3-methoxyl-3-methyl-1-butanol) copper nanoinks, containing MMB (3-methoxyl-3-methyl-1-butanol), porosity as low as 2.4% was achieved on polyimide substrates. The same process was repeated with the same copper ink containing MMB (3-methoxyl-3-methyl-1-butanol), and achieving 2.4%-5.6% porosity. A new fresh replicated ink was also produced for comparison, where the porosity was between 5.6%-6.8%. Previously, the porosity increased after sintering. But this time, the porosity decreased after sintering and it was well correlated with resistivity (see FIG. 16). With high porosity samples, the film appearance clearly showed a light brown color (not shiny). The sample with 2.4% porosity had a shiny copper color appearance. In order to achieve a low porosity film, the photosintering energy should be as high as possible, but below the blow-off threshold energy. Observed were many ventilation holes formed at metal grain boundaries during the fierce and rapid photosintering process as organic materials became volatile and started to outgas.

Experiments set up:

A. Ink material: identified as I-65 containing MMB (3-methoxyl-3-methyl-1-butanol)
   Substrate: Kapton E
   Treatment of ink prior to printing: speed mixer, sonicated, and tumbled, respectively.
   Printing: drawdown coated (drawdown printing uses a metal rod to push ink in one direction and a constant gap between the rod and substrate is kept during moving the roll forward to obtain an even thick coating on a substrate.)
   Drying: 100° C. for 60 minutes
   Sintering: photosintered with a commercially available Novacentrix photosintering machine at 1100 V with 1000 μsec pulse B. Ink material: identified as I-65 containing MMB (3-methoxyl-3-methyl-1-butanol)
   Substrate: Kapton E
   Printing: drawdown coated three months previous, but not sintered
   Drying: 100° C. for 60 minutes
   Sintering: photosintered with Novacentrix machine at 1130 volts with a 1000 μsec pulse C. Ink material: identified as I-73 MMB-2B4-4 GB1-53JYN
   Substrate: Kapton E
   Printing: drawdown coated
   Drying: 100° C. for 60 minutes
   Sintering: photosintered with Novacentrix machine at 1100 volts with a 1000 μsec pulse Results:

A. Ink I-65 with treatments prior to printing

The ink was stored in a refrigerator for three months. It was treated, such as with speed mixing, sonicating, or tumbling, prior to drawdown printing. Samples were processed as a batch through standard procedures. After the copper film was characterized, it was then sent for focus ion beam (FIB) analysis.

Figure 9A:
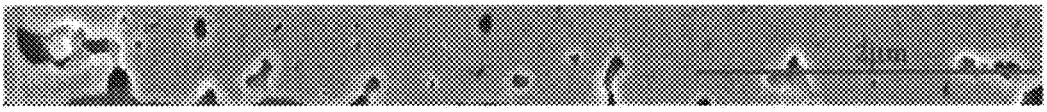
FIG. 9A shows an FIB image of a sample treated with a speed mixer after sintering.
Figure 9B:
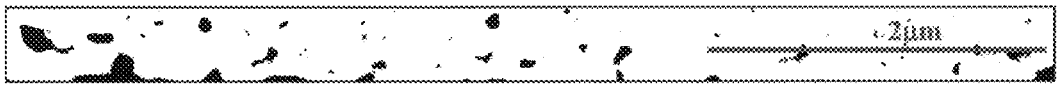
FIG. 9B shows a binary image of the sample of FIG. 9A showing that it possesses 5.6% porosity.
Figure 10A:
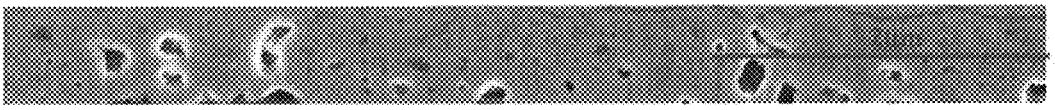
FIG. 10A shows an FIB image of a sample treated with a sonicating process after sintering.
Figure 10B:
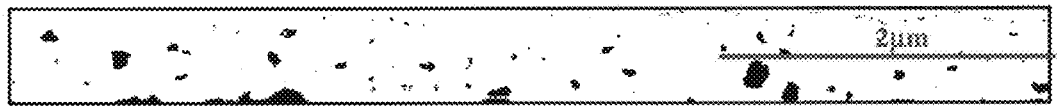
FIG. 10B shows a binary image of the sample of FIG. 10A showing that it possesses 3.9% porosity.
Figure 11A:
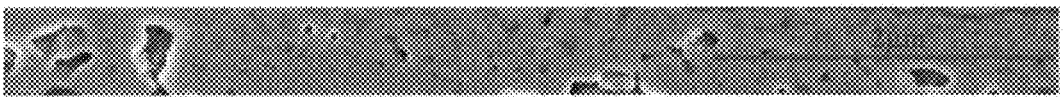
FIG. 11A shows an FIB image of a sample treated with a tumbling process after sintering.
Figure 11B:
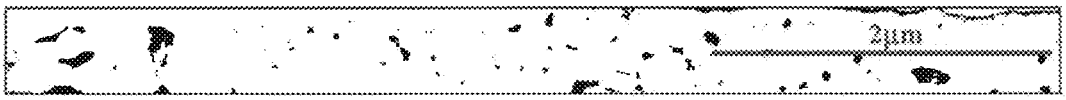
FIG. 11B shows a binary image of the sample of FIG. 11A, indicating that it possesses 4.7% porosity.
Figure 12A:
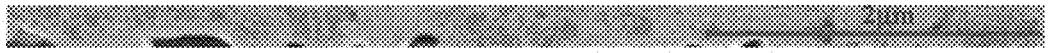
FIG. 12A shows an FIB image of a sample after sintering.
Figure 12B:
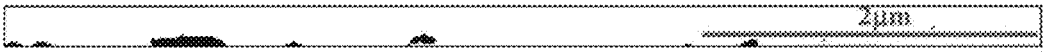
FIG. 12B shows a binary image of the sample of FIG. 12A, indicating that it possesses 2.4% porosity.

FIG. 9A shows an FIG image of the sample treated with a speed mixer after sintering, while FIG. 9B shows a binary image of the sample indicating that it possesses a 5.6% porosity. FIG. 10A shows an FIB image of a sample treated with sonicating after a sintering process, while FIG. 10B shows a binary image of the sample indicating that it possesses a 3.9% porosity. FIG. 11A shows an FIB image of a sample treated with tumbling after a sintering process, while FIG. 11B shows a binary image of the sample indicating that it possesses a 4.7% porosity. Among all three different treatments prior to drawdown printing, no significance observed relative to porosity.

B. I-65 ink printed on polyimide substrates three months previous, but not sintered In order to rule out any possible machine variable for the sintering, we took a piece of polyimide with I-65 ink printed thereon three month previous, but not sintered at that time. After the three month delay, the sintering process was performed and the film characterization then measured on sample 7305A.

Figure 13A:
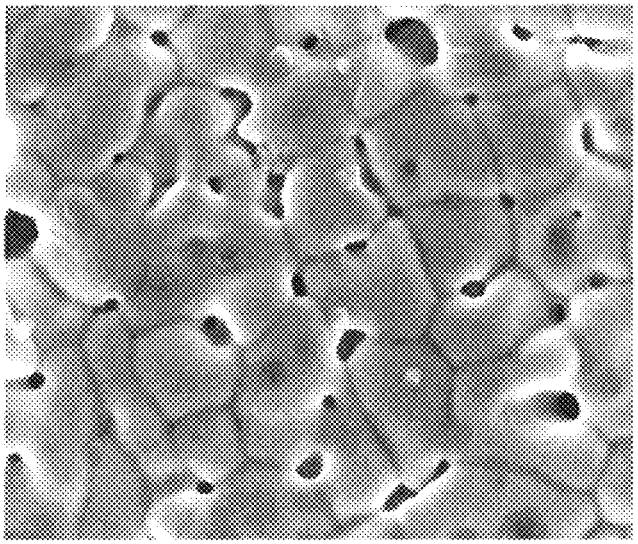
FIG. 13A shows an FIB image of a top view of a sample after photosintering.
Figure 13B:
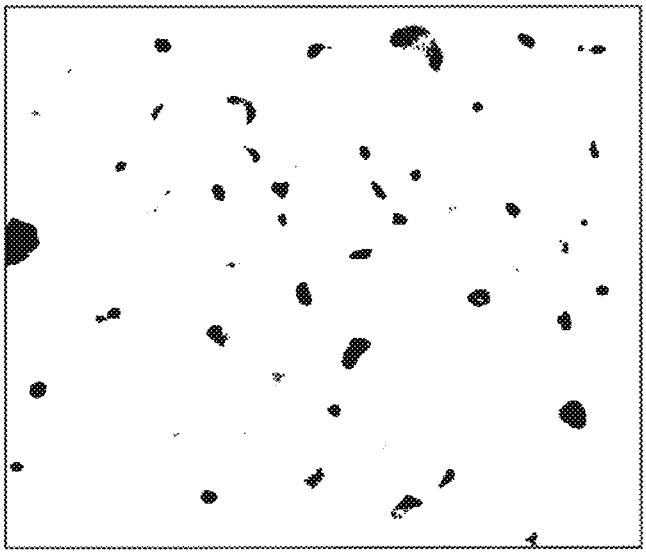
FIG. 13B shows a binary image of the sample of FIG. 13A, indicating that it possesses 2.3% porosity, showing that there are a few pores in the film as ventilation holes at metal grain boundaries.

FIG. 13A shows an FIB image of a top view of the sample after the photosintering process was performed. FIG. 13B is a binary image indicating that the sample possesses a 2.4% porosity. There were a few pores in the film as ventilation holes at the metal grain boundaries. We were able to achieve 2.4% porosity as before even with respect to the film printed three months earlier. That indicated the copper film was quite stable after printing and drying.

C. I-73 ink replicated of I-65

Figure 14A:
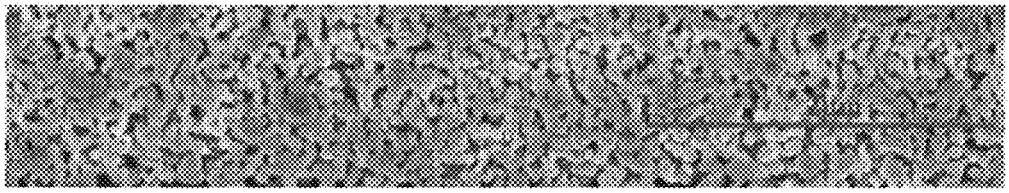
FIG. 14A shows an FIB image of a sample before photosintering.
Figure 14B:
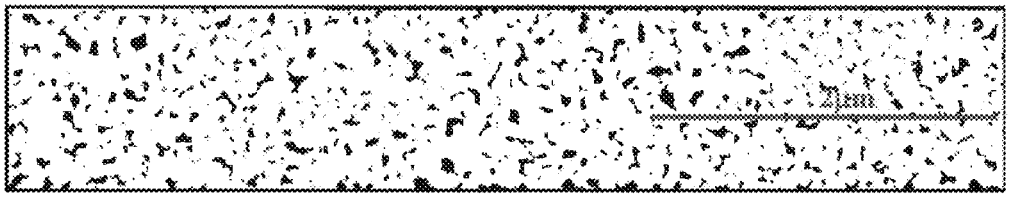
FIG. 14B shows a binary image of the sample of FIG. 14A, indicating that it possesses 9.3% porosity.
Figure 15A:
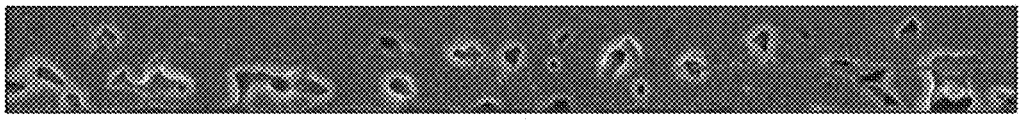
FIG. 15A shows an FIB image of a sample after photosintering.
Figure 15B:
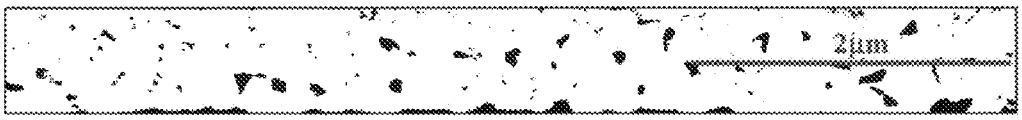
FIG. 15B shows a binary image of the sample of FIG. 15A, indicating that it possesses 5.6% porosity.

A new fresh ink I-73 was produced to repeat the low porosity process. Samples went through the same processes as other samples. FIG. 14A shows an FIB image of a top view of the sample before a photosintering process was performed. FIG. 14B is a binary image indicating that the sample possesses a 9.3% porosity. FIG. 15A shows an FIB image of a top view of the sample after the photosintering process was performed. FIG. 15B is a binary image indicating that the sample possesses a 5.6% porosity.

The invention claimed is:

1. A method for making a material conductive comprising:

depositing a film of nanoparticles on a substrate; and performing a mechanical sintering process at room temperature on the film in a manner that applies shearing forces to the film resulting in the film of nanoparticles possessing a property of conductivity greater than before the mechanical sintering process is performed.

2. The method as recited in claim 1, wherein the film of nanoparticles comprises metallic nanoparticles.

3. The method as recited in claim 2, wherein the metallic nanoparticles are copper nanoparticles.

4. The method as recited in claim 1, wherein the mechanical sintering process comprises applying an ultrasonic bonding tip to the film of nanoparticles.

5. The method as recited in claim 4, further comprising physically pressing the ultrasonic bonding tip against the film of nanoparticles.

6. The method as recited in claim 1, wherein the mechanical sintering process comprises physically pressing against the film of nanoparticles between rollers.

7. The method as recited in claim 1, wherein the film of nanoparticles is deposited on the substrate with an ink-jetting process.

8. The method as recited in claim 1, wherein the mechanical sintering process comprises applying a uniaxial pressure against the film of nanoparticles.

9. The method as recited in claim 1, wherein the mechanical sintering process comprises applying a hydrostatic pressure against the film of nanoparticles.

10. The method as recited in claim 1, wherein the mechanical sintering process causes the nanoparticles to experience grain boundary sliding between each other.

11. The method as recited in claim 1, wherein the film of nanoparticles is deposited on the substrate with a powder deposition process.

12. The method as recited in claim 1, wherein the substrate is a polyimide substrate.

13. The method as recited in claim 1, further comprising photosintering the film of nanoparticles subsequent to the performing of the mechanical sintering process.

14. The method as recited in claim 5, wherein the physical pressing of the ultrasonic bonding tip against the film of nanoparticles is applied with a force up to and including 30 grams.

15. The method as recited in claim 5, wherein the physical pressing of the ultrasonic bonding tip against the film of nanoparticles is performed with a pressure up to and including 30 MPa.

16. The method as recited in claim 13, wherein the photosintering of the film of nanoparticles results in a photoreduction of copper oxides within the film into metal copper.

17. A method for making a material conductive comprising:

depositing a film of nanoparticles on a substrate; and performing a mechanical sintering process at room temperature on the film in a manner that applies shearing forces to the film resulting in the film of nanoparticles possessing a property of conductivity greater than before the mechanical sintering process is performed, wherein the mechanical sintering process comprises physically pressing a spatula against the film of nanoparticles.

18. The method as recited in claim 17, wherein the mechanical sintering process is performed on the film without externally applied heat.

19. A method for making a material conductive comprising:

depositing a film of nanoparticles on a substrate; and performing a mechanical sintering process on the film in a manner that applies shearing forces to the film resulting in the film of nanoparticles possessing a property of conductivity greater than before the mechanical sintering process is performed, wherein the mechanical sintering process is performed on the film without application of heat from an external source.

20. The method as recited in claim 19, wherein the mechanical sintering process is performed on the film at a temperature less than 50° C.

21. The method as recited in claim 19, wherein the mechanical sintering process is performed on a film at substantially room temperature.

* * * * *